US008863979B2

(12) United States Patent
El-Saden et al.

(10) Patent No.: US 8,863,979 B2
(45) **Date of Patent: *Oct. 21, 2014**

(54) SEAL MECHANISM FOR BEVERAGE CONTAINER

(71) Applicant: Ignite USA, LLC, Chicago, IL (US)

(72) Inventors: Sami M. El-Saden, Winnetka, IL (US); Daniel M. Wodka, Chicago, IL (US); Joe Y. Chiou, Wilmette, IL (US)

(73) Assignee: Ignite USA, LLC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/094,128

(22) Filed: Dec. 2, 2013

(65) Prior Publication Data

US 2014/0084002 A1 Mar. 27, 2014

Related U.S. Application Data

(63) Continuation of application No. 13/610,406, filed on Sep. 11, 2012.

(60) Provisional application No. 61/534,192, filed on Sep. 13, 2011.

(51) Int. Cl.

| | |
|---|---|
| ***B65D 51/18*** | (2006.01) |
| ***A47G 19/22*** | (2006.01) |
| ***B65D 43/26*** | (2006.01) |
| ***B65D 43/22*** | (2006.01) |

(52) U.S. Cl.

CPC ..... *A47G 19/2272* (2013.01); *B65D 51/18* (2013.01); *B65D 43/26* (2013.01); *B65D 43/22* (2013.01)

USPC ..... 220/715; 220/254.1; 220/254.9; 220/254.3; 220/829

(58) Field of Classification Search

USPC ..... 220/254.3, 254.1, 715, 826, 254.9

See application file for complete search history.

(56) References Cited

U.S. PATENT DOCUMENTS

| | | | |
|---|---|---|---|
| 830,142 | A | 9/1906 | Ebbing |
| 1,072,588 | A | 9/1913 | Duncan |

(Continued)

FOREIGN PATENT DOCUMENTS

| | | |
|---|---|---|
| JP | 2005193944 | 7/2005 |
| WO | 2005/115204 | 12/2005 |

OTHER PUBLICATIONS

International Preliminary Report on Patentability for International Application No. PCT/US2012/064801, mailed May 20, 2014.

*Primary Examiner* — Fenn Mathew
*Assistant Examiner* — Jennifer Castriotta
(74) *Attorney, Agent, or Firm* — McDermott Will & Emery LLP

(57) ABSTRACT

A lid assembly for a beverage container having a lid housing, a seal assembly and a trigger member. The seal assembly has one or more drink seals that engage a corresponding one or more drink apertures to close the drink apertures. The seal assembly is rotatedly connected to the lid housing and movable between a use position and a cleaning position for cleaning. The trigger member is connected to the lid housing and is capable of engaging the seal assembly in the use position, but not in the cleaning position. The trigger member is connected to the seal assembly such that the vent aperture is opened during a first portion of the operation of the trigger, and the drink apertures are opened during a second portion of the operation of the trigger so that the vent aperture is opened before the drink apertures.

15 Claims, 8 Drawing Sheets

(56) References Cited

U.S. PATENT DOCUMENTS

| | | | |
|---|---|---|---|
| 2,193,232 | A | 3/1940 | Hacmac |
| 2,447,870 | A | 8/1948 | Polcyn |
| 2,622,420 | A | 12/1952 | Rice |
| 2,799,437 | A | 7/1957 | Jepson |
| 3,059,816 | A | 10/1962 | Goldstein |
| 3,635,380 | A | 1/1972 | Fitzgerald |
| 3,739,938 | A | 6/1973 | Paz |
| 3,964,631 | A | 6/1976 | Albert |
| 3,967,748 | A | 7/1976 | Albert |
| 3,972,443 | A | 8/1976 | Albert |
| 4,094,433 | A | 6/1978 | Numbers |
| 4,099,642 | A | 7/1978 | Nergard |
| 4,133,446 | A | 1/1979 | Albert |
| 4,136,799 | A | 1/1979 | Albert |
| 4,171,060 | A | 10/1979 | Howard et al. |
| 4,212,408 | A | 7/1980 | Valenzona |
| 4,276,992 | A | 7/1981 | Susich |
| 4,303,173 | A | 12/1981 | Negard |
| D288,667 | S | 3/1987 | Miner |
| 4,686,725 | A | 8/1987 | Mitchell |
| 4,706,313 | A | 11/1987 | Murphy |
| 4,711,372 | A | 12/1987 | Gach |
| 4,712,704 | A | 12/1987 | Ramsey et al. |
| 4,779,766 | A | 10/1988 | Kinsley |
| 4,801,053 | A | 1/1989 | Kaster |
| 4,881,668 | A | 11/1989 | Kitterman et al. |
| 4,901,387 | A | 2/1990 | Luke |
| D315,872 | S | 4/1991 | Bixler |
| 5,025,519 | A | 6/1991 | Spann et al. |
| 5,039,158 | A | 8/1991 | Maier |
| 5,070,560 | A | 12/1991 | Wilkinson |
| 5,082,134 | A | 1/1992 | Ramsey |
| 5,118,014 | A | 6/1992 | Hestehave et al. |
| 5,153,977 | A | 10/1992 | Toida et al. |
| 5,163,196 | A | 11/1992 | Graebe et al. |
| 5,169,016 | A | 12/1992 | Hinz, Jr. |
| 5,179,742 | A | 1/1993 | Oberle |
| 5,186,353 | A | 2/1993 | Ramsey |
| 5,199,597 | A | 4/1993 | Gladish |
| 5,222,623 | A | 6/1993 | Eger et al. |
| 5,244,113 | A | 9/1993 | Stymiest |
| 5,249,703 | A | 10/1993 | Karp |
| 5,252,278 | A | 10/1993 | Spann et al. |
| 5,307,950 | A | 5/1994 | Li |
| D355,322 | S | 2/1995 | Ackley et al. |
| 5,412,821 | A | 5/1995 | Wilkinson |
| 5,427,271 | A | 6/1995 | Wang |
| 5,461,741 | A | 10/1995 | Graebe |
| 5,462,185 | A | 10/1995 | Walker, III |
| 5,465,866 | A | 11/1995 | Belcastro |
| 5,477,980 | A | 12/1995 | Chaffin |
| 5,485,938 | A | 1/1996 | Boersma |
| D367,611 | S | 3/1996 | Wagner et al. |
| D373,927 | S | 9/1996 | Kramer et al. |
| 5,570,797 | A | 11/1996 | Yeh |
| 5,573,139 | A | 11/1996 | Yeh |
| 5,580,504 | A | 12/1996 | Spann et al. |
| 5,586,346 | A | 12/1996 | Stacy et al. |
| 5,596,781 | A | 1/1997 | Graebe |
| 5,606,754 | A | 3/1997 | Hand et al. |
| 5,630,238 | A | 5/1997 | Weismiller et al. |
| 5,649,331 | A | 7/1997 | Wilkinson et al. |
| 5,652,985 | A | 8/1997 | Wilkinson et al. |
| 5,666,681 | A | 9/1997 | Meyer et al. |
| 5,680,951 | A | 10/1997 | Feltman, III et al. |
| 5,689,845 | A | 11/1997 | Sobieralski |
| D386,948 | S | 12/1997 | Wissinger |
| 5,753,289 | A | 5/1998 | Ness |
| D394,778 | S | 6/1998 | Arns et al. |
| D397,905 | S | 9/1998 | Hsu |
| 5,845,352 | A | 12/1998 | Matsler et al. |
| D404,613 | S | 1/1999 | Hatsumoto et al. |
| D406,006 | S | 2/1999 | Hatsumoto et al. |
| D408,221 | S | 4/1999 | Asberg |
| D416,755 | S | 11/1999 | Trombly |
| 5,987,668 | A | 11/1999 | Ackley |
| D417,360 | S | 12/1999 | Bickert et al. |
| 6,010,029 | A | 1/2000 | Wang |
| 6,036,271 | A | 3/2000 | Wilkinson et al. |
| 6,053,474 | A | 4/2000 | Stucke et al. |
| 6,098,834 | A | 8/2000 | Hatsumoto et al. |
| 6,102,244 | A | 8/2000 | Kuwano et al. |
| 6,119,291 | A | 9/2000 | Osborne et al. |
| 6,126,035 | A | 10/2000 | Schaper et al. |
| 6,158,608 | A | 12/2000 | Schlattl |
| RE37,016 | E | 1/2001 | Morano |
| D437,229 | S | 2/2001 | Andrew |
| 6,223,369 | B1 | 5/2001 | Maier et al. |
| 6,276,560 | B1 | 8/2001 | Belcastro |
| D447,693 | S | 9/2001 | Warner et al. |
| 6,324,709 | B1 | 12/2001 | Ikeda et al. |
| 6,351,863 | B1 | 3/2002 | Meyer et al. |
| 6,352,166 | B1 | 3/2002 | Copeland |
| 6,401,990 | B1 | 6/2002 | Walters et al. |
| D460,894 | S | 7/2002 | Ziegenfus et al. |
| 6,443,325 | B1 | 9/2002 | Schaper et al. |
| 6,471,085 | B1 | 10/2002 | Gallo |
| D470,009 | S | 2/2003 | Turchi et al. |
| D471,808 | S | 3/2003 | de Castro Couto |
| 6,557,717 | B1 | 5/2003 | Keck |
| 6,623,080 | B2 | 9/2003 | Clapper |
| 6,644,490 | B2 | 11/2003 | Clarke |
| 6,679,397 | B2 | 1/2004 | Smith et al. |
| 6,701,556 | B2 | 3/2004 | Romano et al. |
| 6,702,137 | B1 | 3/2004 | Kowa et al. |
| 6,732,875 | B2 | 5/2004 | Smith et al. |
| 6,732,876 | B2 | 5/2004 | Belcastro |
| 6,732,964 | B2 | 5/2004 | Couchey |
| 6,763,964 | B1 | 7/2004 | Hurlbut et al. |
| 6,782,574 | B2 | 8/2004 | Totton et al. |
| 6,854,615 | B2 | 2/2005 | von Ronn et al. |
| D502,844 | S | 3/2005 | Roho |
| 6,874,185 | B1 | 4/2005 | Phillips et al. |
| 6,901,617 | B2 | 6/2005 | Sprouse, II et al. |
| D508,185 | S | 8/2005 | Gauss |
| 6,922,863 | B2 | 8/2005 | Giori et al. |
| 6,928,681 | B1 | 8/2005 | Stacy |
| 6,952,852 | B2 | 10/2005 | Reeder et al. |
| 6,976,281 | B2 | 12/2005 | Schunk et al. |
| 6,978,910 | B2 | 12/2005 | Sanders et al. |
| D513,452 | S | 1/2006 | Parve |
| 7,011,227 | B2 | 3/2006 | Ward et al. |
| D522,794 | S | 6/2006 | Imar |
| D523,340 | S | 6/2006 | Westphal |
| 7,073,678 | B1 | 7/2006 | Dibdin et al. |
| D526,898 | S | 8/2006 | Isono et al. |
| D526,899 | S | 8/2006 | Mangin et al. |
| 7,086,107 | B2 | 8/2006 | Ellis et al. |
| D529,761 | S | 10/2006 | Trombly |
| D533,064 | S | 12/2006 | Glynn et al. |
| 7,195,137 | B2 | 3/2007 | Belcastro |
| D540,625 | S | 4/2007 | Sandberg |
| 7,201,288 | B2 | 4/2007 | von Ronn et al. |
| D541,572 | S | 5/2007 | Watanabe |
| D544,300 | S | 6/2007 | Tien |
| 7,229,134 | B2 | 6/2007 | Ito |
| D547,122 | S | 7/2007 | Gluck |
| D547,611 | S | 7/2007 | Seum et al. |
| D548,008 | S | 8/2007 | Lin |
| D548,508 | S | 8/2007 | Tonelli |
| D552,990 | S | 10/2007 | Vogel |
| D554,433 | S | 11/2007 | Gluck |
| D554,992 | S | 11/2007 | Mangin et al. |
| D555,000 | S | 11/2007 | Bunce et al. |
| D555,514 | S | 11/2007 | Munn |
| D555,970 | S | 11/2007 | Schreitmueller et al. |
| D558,111 | S | 12/2007 | Banks, III |
| D560,435 | S | 1/2008 | Meehan |
| D564,840 | S | 3/2008 | Williams |
| D564,841 | S | 3/2008 | Clemens et al. |
| D564,874 | S | 3/2008 | Mangin et al. |
| D569,182 | S | 5/2008 | Homma |
| D572,531 | S | 7/2008 | Romandy et al. |
| D573,404 | S | 7/2008 | Wahl |

(56) References Cited

U.S. PATENT DOCUMENTS

| | | | |
|---|---|---|---|
| 7,413,096 | B2 | 8/2008 | Morgan et al. |
| D577,582 | S | 9/2008 | Walsh et al. |
| D577,958 | S | 10/2008 | Homma |
| D581,727 | S | 12/2008 | Pinelli et al. |
| D584,107 | S | 1/2009 | George |
| D587,060 | S | 2/2009 | Tong Chi Chung |
| D587,969 | S | 3/2009 | Gilbert |
| D588,411 | S | 3/2009 | Watanabe |
| D589,750 | S | 4/2009 | Liu et al. |
| D592,012 | S | 5/2009 | Carreno |
| D592,456 | S | 5/2009 | Pinelli |
| D592,905 | S | 5/2009 | Pinelli |
| D592,913 | S | 5/2009 | Pinelli |
| 7,546,933 | B2 | 6/2009 | Pinelli |
| D611,764 | S | 3/2010 | Wahl et al. |
| D623,473 | S | 9/2010 | Chen |
| D623,474 | S | 9/2010 | Carlson et al. |
| D623,476 | S | 9/2010 | Carlson et al. |
| D629,653 | S | 12/2010 | Gullickson et al. |
| D634,161 | S | 3/2011 | Roth et al. |
| RE42,484 | E | 6/2011 | Kitamura et al. |
| D640,094 | S | 6/2011 | Carlson et al. |
| 7,997,442 | B2 | 8/2011 | Pinelli |
| D648,985 | S | 11/2011 | Chiu et al. |
| D656,787 | S | 4/2012 | Phillips et al. |
| D658,443 | S | 5/2012 | Chiu et al. |
| 2003/0071041 | A1 | 4/2003 | Vogel |
| 2005/0028289 | A1 | 2/2005 | Hakamium |
| 2006/0043091 | A1 | 3/2006 | Pinelli et al. |
| 2006/0226160 | A1 | 10/2006 | Elsaden et al. |
| 2007/0170184 | A1 | 7/2007 | Canedo |

42
130
132
52
46
56
104b
72
66
96
68
64
98
104a
102
120
122
70
16
45
60
62
86
110
48

FIG. 10
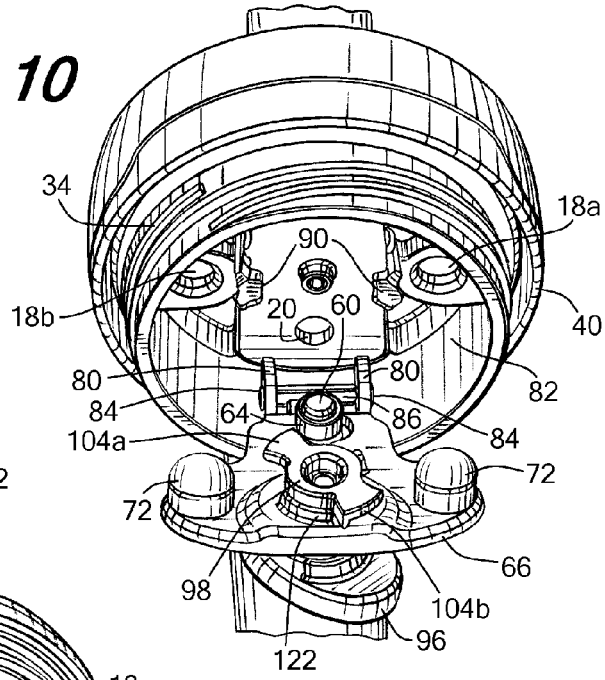
FIG. 11
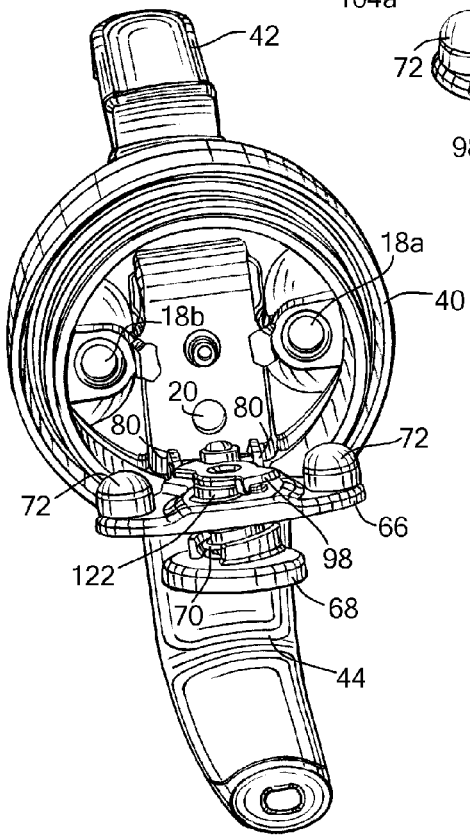
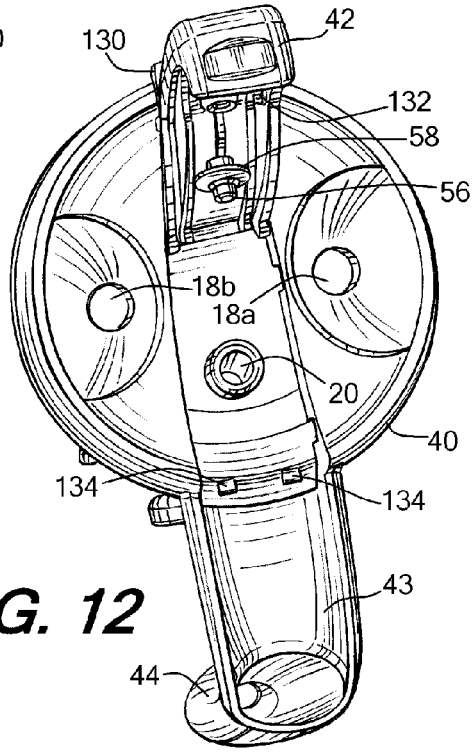
FIG. 12

FIG. 13
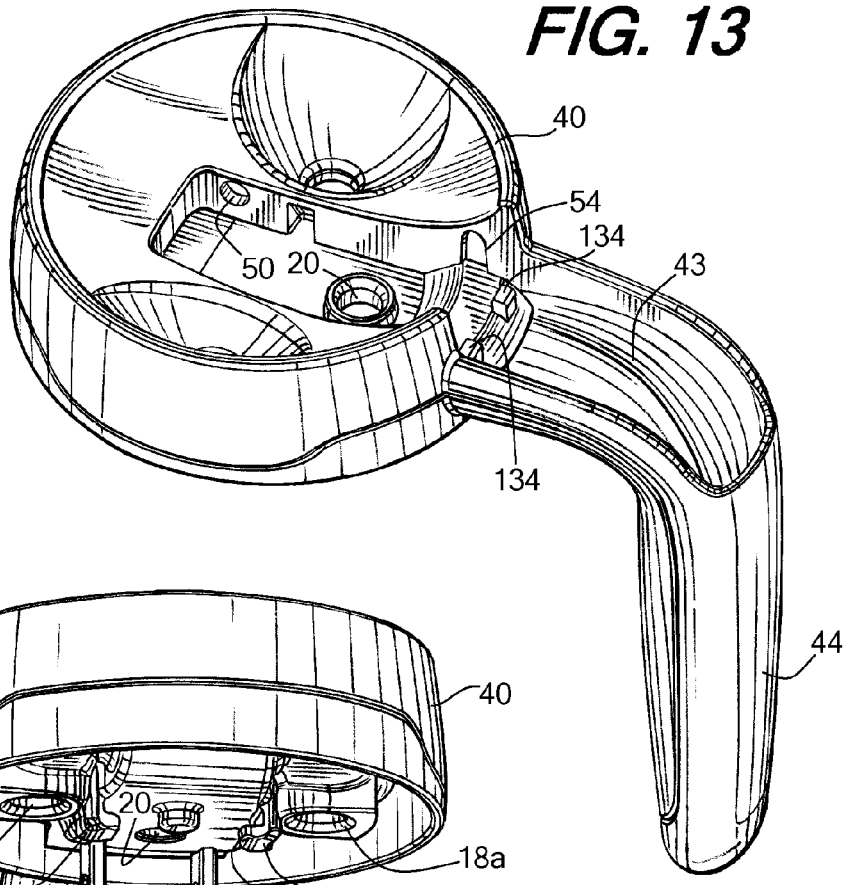
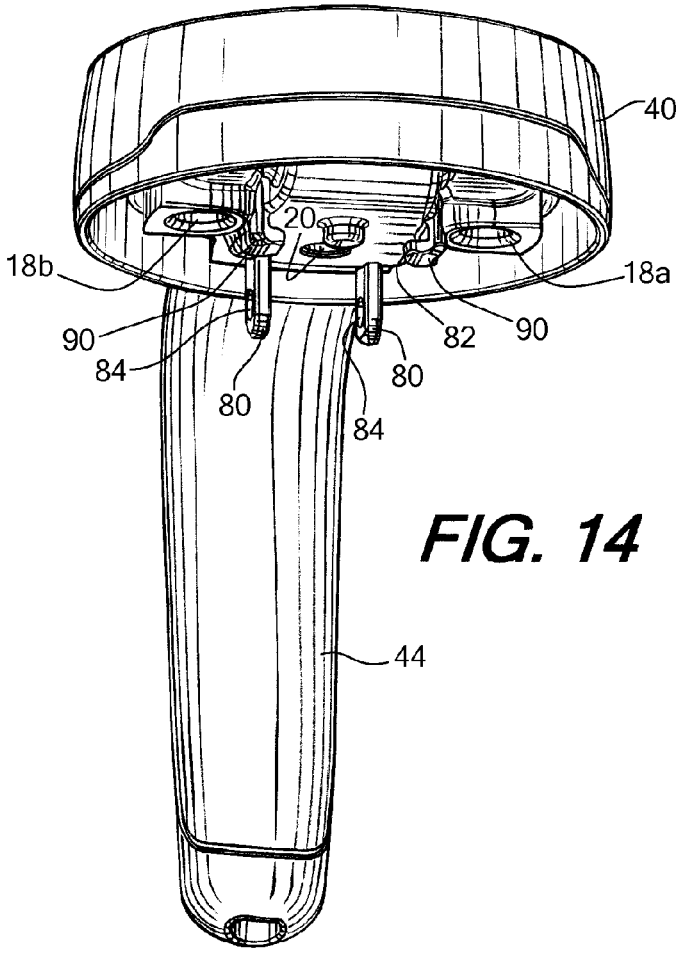
FIG. 14

SEAL MECHANISM FOR BEVERAGE CONTAINER

CROSS-REFERENCE TO RELATED APPLICATIONS

This application is a continuation of U.S. patent application Ser. No. 13/610,406, filed Sep. 11, 2012, which claims the benefit of U.S. Provisional Patent Application No. 61/534,192, filed Sep. 13, 2011, both of which are expressly incorporated herein by reference and made a part hereof.

FEDERALLY SPONSORED RESEARCH OR DEVELOPMENT

Not Applicable.

TECHNICAL FIELD

The present invention relates generally to a beverage container, and more specifically to a movable trigger/seal mechanism for a beverage container.

BACKGROUND OF THE INVENTION

Beverage containers and seal/trigger mechanisms for beverage containers are well known in the art. Traditionally, seal/trigger mechanisms are located in the lid of the beverage container and are secured in a fixed location in the lid. While such beverage containers and seal/trigger mechanisms according to the prior art provide a number of advantages, they nevertheless have certain limitations. For example, debris may be retained between certain components that are secured together. Further, the area between the seals associated with the seal mechanism and the lid, and other components of the seal mechanism are difficult to properly clean, especially in a dishwasher environment. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY

According to one embodiment, the disclosed subject technology relates to a lid for a beverage container having a drop-down seal assembly for easy cleaning of the seal assembly and the associated drink apertures, but where the seal assembly is not disassembled or removed from the lid during conversion from the use position to the cleaning position.

The disclosed subject technology further relates to a lid having a seal assembly and a trigger member. The seal assembly has a first drink seal that engages a first drink aperture to close the first drink aperture. The seal assembly is rotatedly connected to the lid housing and movable between a first or operable position, and a second or cleaning position. The seal assembly can be rotated away from a drink surface of the lid housing so that the first drink aperture is open for cleaning the lid assembly in the cleaning position. The trigger member is connected to the lid housing and is capable of engaging the seal assembly in the operable position, but the trigger assembly cannot engage the seal assembly in the cleaning position.

The disclosed technology further relates to an embodiment where the seal assembly further comprises a second drink seal that engages a second drink aperture to close the second drink aperture.

The disclosed technology further relates to an embodiment where the trigger member is rotatedly connected to the lid housing, and wherein the trigger member can be rotated from a normal or use position to an open position for cleaning purposes.

The disclosed technology further relates to an embodiment having a locking member to lock the seal assembly in the operable position when the locking member is in a locked state. The locking member is transitionable to an unlocked state to allow the seal assembly to translate to the cleaning position.

The disclosed technology further relates to an embodiment comprising a trigger lock connected to the trigger member. The trigger lock prevents engagement of the seal assembly by the trigger member when the seal assembly is in the operable position.

The disclosed technology further relates to a lid assembly for a drinking container comprising a lid housing, a seal assembly and a trigger. The lid housing has a first drink aperture, a second drink aperture, and a separate vent aperture. The seal assembly has a first drink seal for the first drink aperture, a second drink seal for the second drink aperture, and a vent seal for the vent aperture. The trigger is mechanically connected to the seal assembly during operation of the trigger to move the first and second drink seals and the vent seal from a closed position to an open position, wherein the vent aperture is opened during a first portion of the operation of the trigger, and wherein the first and second drink apertures are opened during a second portion of the operation of the trigger so that the vent aperture is opened before the first and second drink apertures.

The disclosed technology further relates to a lid assembly for a drinking container comprising a lid housing, a seal assembly and a trigger. The lid assembly further comprises a vent spring operably connected to the vent seal of the seal assembly, and a drink spring operably connected to the first and second drink seals of the seal assembly, wherein a spring constant of the drink spring is greater than a spring constant of the vent spring.

The disclosed technology further relates to a lid assembly for a drinking container comprising a lid housing, a seal assembly, and a trigger mechanism. The lid housing has a first drink aperture, a second drink aperture, and a separate vent aperture. The seal assembly has a first drink seal and a second drink seal, and a vent seal is operably connected to the seal assembly. The trigger mechanism is mechanically connected to both the vent seal and to the seal assembly during operation of the trigger mechanism to move the first and second drink seals and the vent seal from a closed position to an open position.

The disclosed technology further relates to an embodiment where the lid housing has a centerline extending about a surface of the lid housing, and wherein a first drink opening is positioned on one side of the centerline and a second drink opening is positioned on the opposing side of the centerline.

The disclosed technology further relates to a lid assembly for a drinking container comprising a lid housing, a seal assembly and a trigger mechanism. The lid housing has a first drink aperture and a separate vent aperture. The seal assembly has a first drink seal and a vent seal. The trigger mechanism is mechanically connected to the seal assembly during operation of the trigger mechanism to move the first drink seal and the vent seal from a closed position to an open position. In this embodiment the trigger mechanism has three positions, a first position, a second position and a third position. The vent aperture is opened and the first drink aperture remains closed when the trigger mechanism reaches the first position. The first drink aperture is opened after the vent aperture when the trigger mechanism reaches the second position. And, the vent opening is subsequently closed but the first drink aperture remains open when the trigger mechanism is in the third position.

The disclosed technology further relates to a lid assembly for a beverage container comprising a lid housing having a drink aperture and a vent aperture. The lid further has a seal assembly having a drink seal that engages the drink aperture to close the drink aperture. A trigger assembly is connected to the lid housing to operate the seal assembly, and a trigger lock is connected to the trigger assembly. The trigger lock is moveable between a first or unlocked position and a second or locked position. The trigger lock forms a continuous ring with an upper portion of the lid housing when the trigger lock is in the unlocked position, and wherein the continuous ring is broken when the trigger lock is transitioned to the locked position.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present invention, it will now be described by way of example only, not by way of limitation, with reference to the accompanying drawings in which:

FIG. 10 is a partial bottom perspective view of one embodiment of the seal mechanism in the open position.

FIG. 11 is a partial bottom perspective view of one embodiment of the seal mechanism in the open position.

FIG. 12 is a top perspective view of one embodiment of the lid housing with the trigger button in the open position.

FIG. 13 is a top-side perspective view of the lid housing of FIG. 12 with the trigger button removed.

FIG. 14 is a bottom-front perspective view of the lid housing of FIG. 12 with the seal mechanism removed.

DETAILED DESCRIPTION

Figure 1:
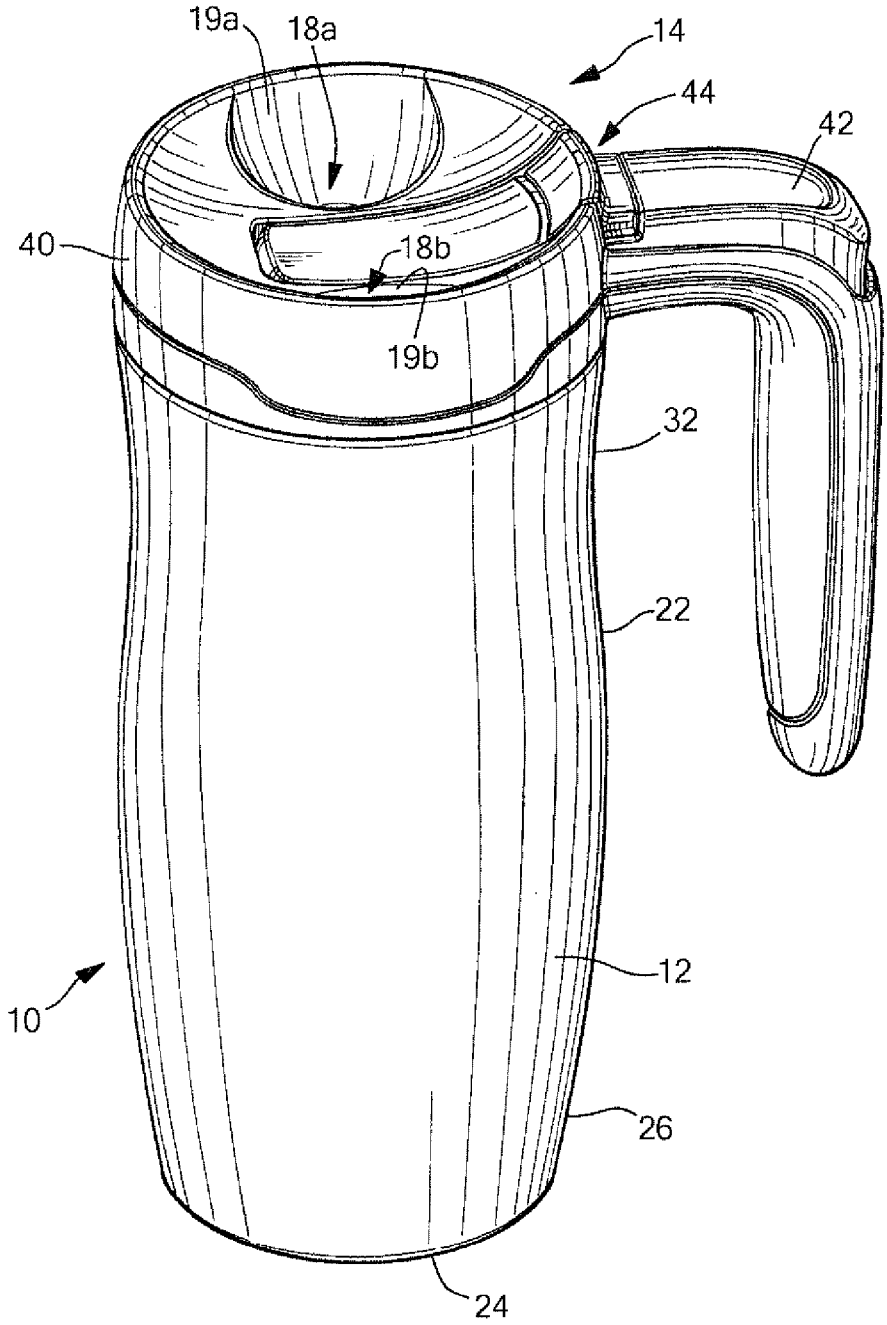
FIG. 1 is a perspective view of one example of a beverage container with a moveable and lockable seal mechanism and trigger mechanism.
Figure 2:
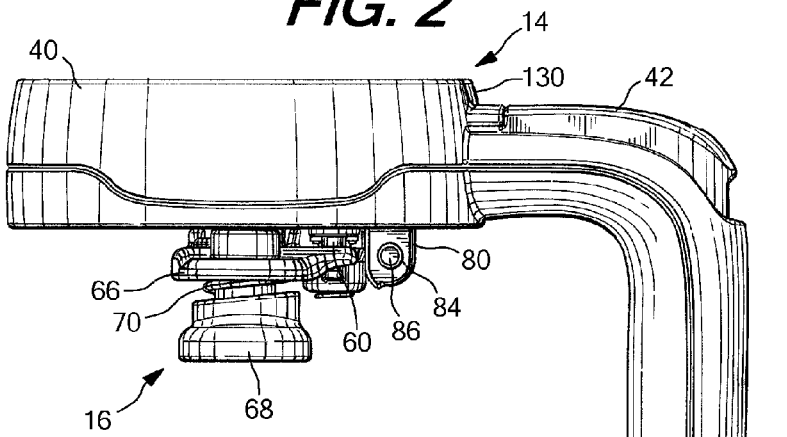
FIG. 2 is a side elevation view of one embodiment of a movable seal mechanism pivotably connected to a lid for a beverage container, the seal mechanism being in the locked or closed position.
Figure 3:
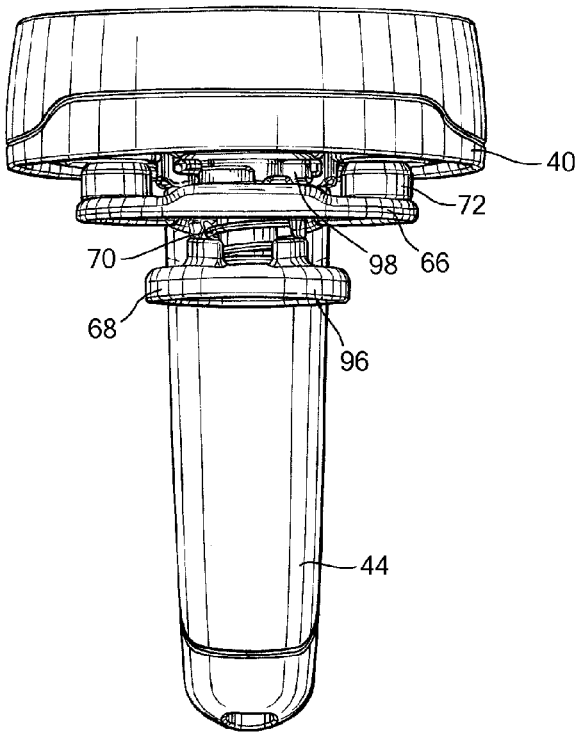
FIG. 3 is a front elevation view of FIG. 2.
Figure 4:
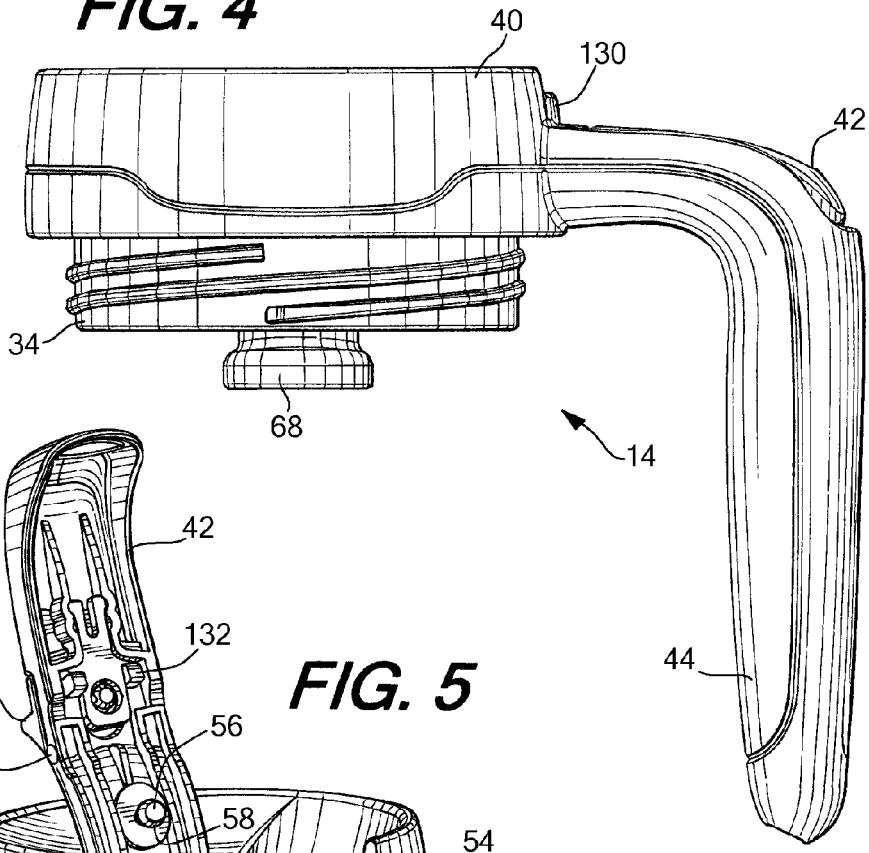
FIG. 4 is a side elevation view of FIG. 2, including a thread ring for the lid.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the figures, and specifically to FIGS. 1-5, there is shown a beverage container 10 generally comprising a container body 12 and a lid assembly 14. The lid assembly 14 has a seal mechanism 16 or seal assembly 16 that operates to open and close at least one drinking aperture 18*a* or 18*b* in the lid assembly 14, and preferably to open and close two drinking apertures 18*a*, 18*b* in the lid assembly. Additionally, the seal assembly 16 also preferably operates to open and close a vent aperture 20 (see FIGS. 10-14) to allow pressure residing within the container body 12 to be initially released through the vent aperture 20 as opposed to the drink apertures 18*a*, 18*b*. In a preferred embodiment, as shown in FIGS. 5 and 10-12, a portion of the seal assembly 16 can be released from a fixed or closed position (i.e., the use position) to a released or open position (i.e., the cleaning position) to allow for cleaning of various components of the seal assembly 16 and for cleaning of areas between components of the seal assembly 16 and the lid assembly 14. Additionally, as shown in FIGS. 5 and 10-12, the trigger button 42 can be moved from the fixed, use or closed position to a released or open position to allow for cleaning of the area between the trigger button 42 and the lid housing 40. Importantly, when the seal assembly 16 and the trigger button 42, respectively, are moved from the use position to the cleaning position, and while they remain in the cleaning position, they are still connected to the lid assembly 14. Accordingly, for cleaning purposes no components need to be removed from the lid assembly 14—they are at all times still connected to the lid assembly 14. Instead, they are relocated to a position that allows for cleaning of the important portions of the lid assembly but they are not removed and therefore cannot be misplaced or disassociated from the lid assembly 14.

In one embodiment the container body 12 comprises a side wall member 22, a bottom member 24 toward a distal end 26 of the side wall member 22, and a liquid retaining cavity (not shown) therebetween. Further, in one embodiment the container body 12 generally comprises a two-part construction of an inner member and an outer member to provide an insulating feature. The area between the inner member and the outer member may be filled with an insulating material or it may be under vacuum.

Figure 6:
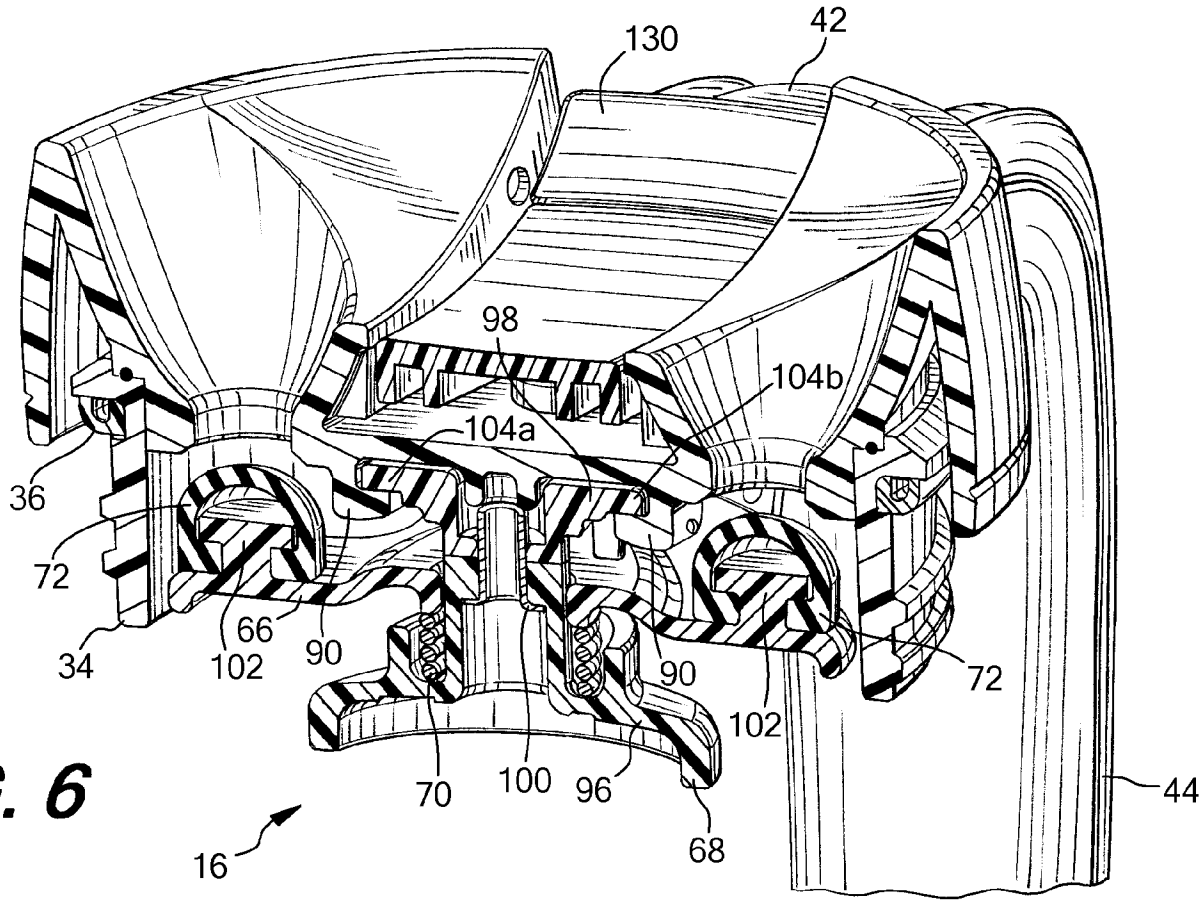
FIG. 6 is a partial cross-section perspective view of one embodiment of the seal mechanism with the cross section being through the drink seals.
Figure 7:
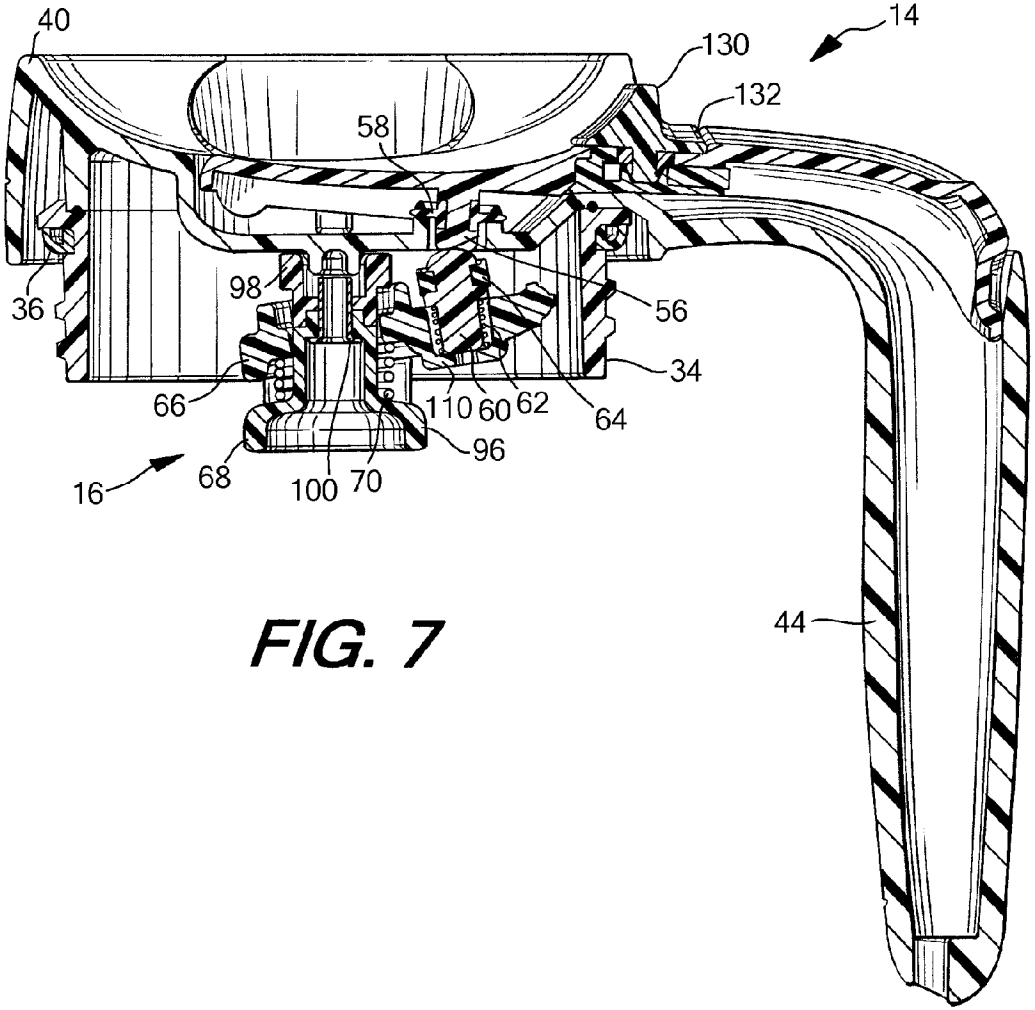
FIG. 7 is a partial cross-section side view of one embodiment of the seal mechanism with the cross section being through the vent seal.

The lid assembly 14 provides a closure to the cavity of the container body 12. In one embodiment, the container body 12 base has a receiver (not shown) at a proximal end 32 of the container body 12 for assisting in securing the lid assembly 14 to the container body 12, and in a preferred embodiment the lid assembly 14 is secured to the container body 12 via the thread ring 34 on the lid assembly 14 and a mating receiver on the container body 12, however, alternate connection means may be utilized. As shown in FIGS. 6 and 7, the lid assembly 14 includes a seal 36 that seals the connection between the container body 12 and the lid assembly 14 to assist in preventing liquid from escaping from the cavity of the container body 12.

In one embodiment the lid assembly 14 includes a lid housing 40 for retaining the seal assembly 16. In one embodiment the thread ring 34 extends from or is fixedly connected to the lid housing 40 as shown in FIG. 6. As shown in FIGS. 1, 5 and 7-9, the lid assembly 14 also has a trigger member or trigger button 42 that operates to actuate the seal assembly 16, and a trigger lock mechanism for locking the trigger member 42 and preventing the user from actuating the seal assembly 16. The lid housing 40 of the lid assembly 14 has a plurality of apertures therein. Preferably, the lid housing 40 contains the drink apertures 18*a*, 18*b* and the vent aperture 20 for providing access to the container cavity knot shown) through the lid housing 40. While the vent aperture 20 is provided in a top of the lid housing 40, it is understood that it may be located elsewhere in the lid housing 40, such as the side of the lid housing 40. In a preferred embodiment, the drink apertures 18*a*, 18*b* are located at the bottom of reservoirs 19*a*, 19*b* formed downwardly from the upper surface of the lid housing 40. With such structure, the drink apertures 18*a*, 18*b* are positioned a distance below the upper surface of the lid housing 40. The reservoirs 19*a* and 19*b* provide several functions. For example, the reservoirs 19*a* and 19*b* operate as a well and serve to allow the user to pool liquid that is being dispensed from the container 10 into the reservoirs 19*a* and 19*b*, including in a pre-fill step, prior to drinking by the user. This is especially beneficial when the liquid in the container 10 is hot and the user desires to allow the contents to briefly cool before being consumed. Additionally, the user is able to slurp the liquid in the reservoir 19*a* and 19*b* as opposed to drinking directly from the drink aperture. Notwithstanding this function, the surface angles and contour of the reservoirs 19*a* and 19*b* are designed to allow liquid that remains in the reservoir when the drink aperture is open to quickly traverse back through the drink aperture and into the container cavity so that less residual liquid remains outside of the drink seal to prevent unwanted drips of residual liquid.

In one embodiment the lid assembly 14 is a handled assembly having a plurality of drink apertures 18*a*, 18*b*. As such, a handle 44 extends from the lid housing 40 for allowing the user to grasp and hold drink container 10. In one embodiment, the trigger member or trigger button 42 resides partially within the handle 44 of the container 10, and preferably within a trigger cavity 43 on the exterior of the lid housing 40. Preferably, when a handle 44 is provided as part of the lid assembly 14, as shown in FIGS. 6 and 10-14, two drink apertures 18*a*, 18*b* are included so that the user can hold the handle 44 with either the user's right hand or left hand and still have a drink aperture positioned in a proper drinking location. Accordingly, in one embodiment one drink aperture 18*a* is positioned on one side of a centerline of the top of the lid housing 40, and the other drink aperture 18*b* is positioned on the opposing side of the centerline of the top of the lid housing 40 in a geometrically symmetric manner.

Referring to FIGS. 6-9, connected to the seal arm 66 of the seal assembly 16 is the seal arm locking member 68, drink spring 70, and a pair of drink seals 72. The seal arm locking member 68 is the component of the seal assembly 16 that is used to lock the seal assembly 16 in the operable position, and unlock the seal assembly 16 for transitioning to the unlocked or cleaning position. In one embodiment, as shown in FIGS. 6 and 7, the seal arm locking member 68 comprises a locking member 96 and an arm lock 98 that are joined to form a unitary seal arm locking member 68 component. Further, in one embodiment the locking member 68 is rotatably connected to the seal assembly 16. In one embodiment, the locking member 96 is fixedly secured to the arm lock 98, such as with a rivet 100. Alternately, the locking member 96 may be fixedly secured to the arm lock 98 with other mechanical means, including adhesives. The locking member 96 locks the seal assembly 16 in the operable position when the locking member 96 is in a locked state. The locking member 96 is transitionable to an unlocked state to allow the seal assembly 16 to translate to the cleaning position. In one embodiment, prior to connecting the locking member 96 to the arm lock 98, the seal arm 66, which has a bore therethrough, is positioned between the locking member 96 and the arm lock 98 of the seal arm locking member 68. The seal arm 66 also has opposing extensions 102, each of which retain a drink seal 72. The drink spring 70 is positioned between the locking member 96 of the seal arm locking member 68, and preferably within a spring retainer of the locking member 96, and the bottom of the seal arm 66. Accordingly, the drink spring 70 exerts a pressure on the seal arm 66 such that the seal arm 66 is forced away from the locking member 96 of the seal arm locking member 68. Thus, when the seal assembly 16 is positioned in the locked or operational position (see FIG. 2), the drink seals 72 will be forced against the lid housing 40 to close the drink apertures 18*a* and 18*b*. Specifically, in one embodiment the first drink seal 72 engages the first drink aperture 18*a* and the second drink seal 72 engages the second drink aperture 18*b*. In a preferred embodiment the drink seals 72 have a domed shape to provide for good sealing with the drink apertures 18*a* and 18*b*, but also to allow liquid that is not consumed by the user during operation of the drinking container 10 to pass by the drink seals 72 and into the container cavity more easily and without disruption. Further, in a preferred embodiment, the drink spring 70 has a greater spring force than the vent spring 62. In this manner, when the user depresses the trigger member 42, because the vent spring 62 has a lower spring force than the drink spring 70, the vent pin 60 will be actuated before the seal arm 66, thereby allowing the vent aperture 20 to be opened before the drink aperture to release pressure from inside the beverage container through the vent opening 20.

In the locked position of the seal assembly 16, see FIGS. 2, 3 and 6-9, the seal assembly 16 is pivoted or rotated toward the drink surface of the lid housing 40 and is locked in place. Specifically, in one embodiment the arm lock 98 portion of the seal arm locking member 68 has two wing arms 104*a*, 104*b*. The wing arms 104*a*, 104*b* each have a cam surface that engages the horizontal portion of the respective retaining prongs 90 (see FIG. 6). In this position, the seal arm locking member 68 is secured to the lid housing 40 through the retaining prongs 90, and the drink seals 72 of the seal assembly 16 are forced against the drink openings 18*a* and 18*b* via the drink spring 70 to close the drink openings 18*a* and 18*b*.

When the user desires to drink from the container 10, the user depresses the trigger member 42. In one embodiment, the trigger 42 is operated by pushing the trigger 42 in a direction substantially parallel to a longitudinal axis of the drinking container. If sufficient force is provided, the trigger member 42 initially depresses the vent pin 60 and vent seal 64 downwardly, compressing the vent spring 62 to initially open the vent aperture 20 during this first portion of the operation of the trigger mechanism. The vent pin 60 will ultimately bottom out in the vent pin receiver 110 of the seal arm 66. Again, if sufficient force is provided through the trigger member 42, during a second portion of the operation stroke of the trigger mechanism, when the vent pin 60 bottoms out in the vent pin receiver 110 of the seal arm 66, the force of the vent pin 60 moving downward will operate to push the seal arm 66 and compress the drink spring 70 to rotate the seal arm 66 about the extensions 86 within the receivers 84 of the lid housing arms 80. Since the seal arm locking member 68 is fixed in the locked position to the retaining prongs 90, the force exerted on the trigger member 42 must also be sufficient to overcome the force of the drink spring 70, thus allowing the seal arm 66 to compress the drink spring 70 and have the drink seals 72 moved away from the drink apertures 18*a* and 18*b* to allow liquid to escape out of the drink apertures 18*a* and 18*b* for drinking. Accordingly, the trigger mechanism is mechanically connected to the seal assembly, including the vent seal and the drink seals, during operation of the trigger mechanism to move the first and second drink seals and the vent seal from the closed position to the open position.

When the user removes force from the drink trigger 42 (i.e., generally by removing their thumb from the trigger 42), the force of the drink spring 70 will force the seal arm 66 to rotate toward the lid housing 40 and thereby have the drink seals 72 forced against the drink openings 18*a* and 18*b* to close the drink openings. Further, the force of the vent spring 62 will force the vent pin 60 and vent seal 64 upwardly toward the lid housing 40 to close the vent opening 20. Accordingly, the trigger mechanism has three positions, a first position, a second position and a third position. The vent aperture is opened and the first and second drink apertures remain closed when the trigger mechanism reaches the first position. The first and second drink apertures are opened after the vent aperture when the trigger mechanism reaches the second position. Finally, the vent opening is subsequently closed but the first and second drink apertures remain open when the trigger mechanism is in the third position.

If the user desires to clean the lid assembly 14, the user can rotate the seal assembly 16 away from the drink surface of the lid housing 40 to provide access to the area between the drink openings 18*a*, 18*b* and the drink seals 72, and access to the area between the vent seal 64 and the vent opening 20. To do such, in one embodiment the user rotates the locking member 96 of the seal arm locking member 68 approximately 50°. By rotating the locking member 96, the arm lock 98 is also rotated and the wing arms 104*a*, 104*b* will be disengaged from the retaining prongs 90 extending from the lid housing 40. When the wing arms 104*a*, 104*b* of the arm locks 98 are disengaged from the retaining prongs 90 the entire trigger assembly 16 can be rotated away from the lid housing 40 about the extensions 86 of the seal arm 66 for cleaning. An additional feature of this embodiment is that the arms 80 interact with ribs on the seal arm 66 in a detent position to maintain the seal assembly 16 in the fully open position until forced back by the user. In this manner the seal assembly 16 will stay in the open position for cleaning, but can then be returned to its operating position by overcoming the detent resistance force. Accordingly, it is seen that the trigger member 42 is capable of engaging the seal assembly 16 when the seal assembly 16 is in the operable position, but the seal assembly 16, by nature of its physical location, cannot be engaged by the trigger member 42 when the seal assembly 16 is in the cleaning position.

Figures 8, 9:
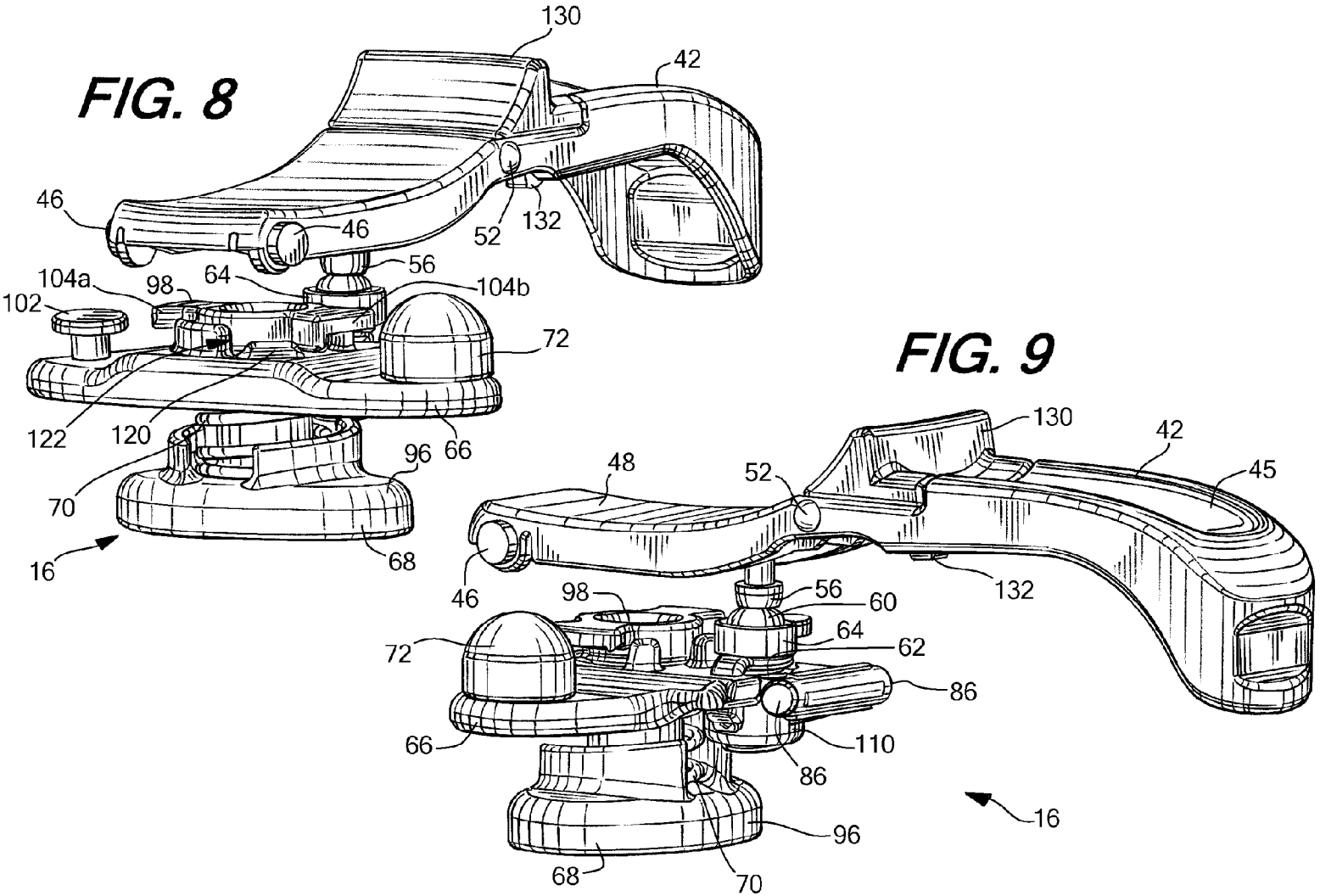
FIG. 8 is a partial front perspective view of one embodiment of the seal mechanism with the lid housing removed.
FIG. 9 is a partial rear perspective view of the view of FIG. 8.

As best shown in FIGS. 2, 3 and 6-11, in various embodiments the seal assembly 16 generally comprises a vent pin 60, a vent spring 62, a vent seal 64, a seal arm 66, a seal arm locking member 68, a drink spring 70, and a pair of drink seals 72. Referring to FIGS. 9-11, in one embodiment the seal assembly 16 is rotatedly or hingedly connected to the lower or interior portion of the lid housing 40 of the lid assembly 14. Preferably, in this embodiment, a pair of arms 80 extend transversely from the interior wall 82 of the lid housing 40 (see FIGS. 10 and 14). The arms 80 have a receiver 84 for rotatably securing the seal arm 66 to the lid housing 40. The receiver 84 in the arms 80 is a bore that is sized to allow extensions 86 from the seal arm 66 to extend and rotate therewithin. Referring to FIG. 9, in one embodiment the extension 86 has shaft-like ends that extend into the receivers 84 in the arms 80 of the lid housing 40. As such, the seal arm 66, and a portion of the seal assembly 16 therewith, can rotate down, approximately 90° in a preferred embodiment from the operable position to the cleaning position, from its engaged position about the extensions 86 that rotate within the receivers 84 to allow access to various components of the seal assembly 16 and lid assembly 14 for cleaning purposes.

As shown in FIGS. 6, 10 and 14, in one embodiment the lid assembly 14 also has a pair of retaining prongs 90 that extend transversely from the interior wall 82 of the lid housing 40. In one embodiment the retaining prongs 90 are generally L-shaped and have a transverse and horizontal portion thereto. The horizontal portions of the pair of retaining prongs 90 extend toward one another as shown in FIG. 6. As explained herein, the retaining prongs 90 operate to assist in securing a portion of the seal assembly 16 to the lid assembly 14. Specifically, the retaining prongs 90 operate to secure a portion of the seal arm locking member 68 when the seal arm locking member 68 is orientated in the locked position (see FIG. 6).

Referring to FIGS. 6-9, connected to the seal arm 66 of the seal assembly 16 is the seal arm locking member 68, drink spring 70, and a pair of drink seals 72. The seal arm locking member 68 is the component of the seal assembly 16 that is used to lock the seal assembly 16 in the operable position, and unlock the seal assembly 16 for transitioning to the unlocked or cleaning position. In one embodiment, as shown in FIGS. 6 and 7, the seal arm locking member 68 comprises a locking member 96 and an arm lock 98 that are joined to form a unitary seal arm locking member 68 component. Further, in one embodiment the locking member 68 is rotatably connected to the seal assembly 16. In one embodiment, the locking member 96 is fixedly secured to the arm lock 98, such as with a rivet 100. Alternately, the locking member 96 may be fixedly secured to the arm lock 98 with other mechanical means, including adhesives. The locking member 96 locks the seal assembly 16 in the operable position when the locking member 96 is in a locked state. The locking member 96 is transitionable to an unlocked state to allow the seal assembly 16 to translate to the cleaning position. In one embodiment, prior to connecting the locking member 96 to the arm lock 98, the seal arm 66, which has a bore therethrough, is positioned between the locking member 96 and the arm lock 98 of the seal arm locking member 68. The seal arm 66 also has opposing extensions 102, each of which retain a drink seal 72. The drink spring 70 is positioned between the locking member 96 of the seal arm locking member 68, and preferably within a spring retainer of the locking member 96, and the bottom of the seal arm 66. Accordingly, the drink spring 70 exerts a pressure on the seal arm 66 such that the seal arm 66 is forced away from the locking member 96 of the seal arm locking member 68. Thus, when the seal assembly 16 is positioned in the locked or operational position (see FIG. 2), the drink seals 72 will be forced against the lid housing 40 to close the drink apertures. Specifically, in one embodiment the first drink seal 72 engages the first drink aperture 18*a* and the second drink seal 72 engages the second drink aperture 18*b*. In a preferred embodiment the drink seals 72 have a domed shape to provide for good sealing with the drink apertures 18*a* and 18*b*, but also to allow liquid that is not consumed by the user during operation of the drinking container 10 to pass by the drink seals 72 and into the container cavity more easily and without disruption. Further, in a preferred embodiment, the drink spring 70 has a greater spring force than the vent spring 62. In this manner, when the user depresses the trigger member 42, because the vent spring 62 has a lower spring force than the drink spring 70, the vent pin 60 will be actuated before the seal arm 66, thereby allowing the vent aperture 20 to be opened before the drink aperture to release pressure from inside the beverage container through the vent opening 20.

In the locked position of the seal assembly 16, see FIGS. 2, 3 and 6-9, the seal assembly 16 is pivoted or rotated toward the drink surface of the lid housing 40 and is locked in place. Specifically, in one embodiment the arm lock 98 portion of the seal arm locking member 68 has two wing arms 104*a*, 104*b*. The wing arms 104*a*, 104*b* each have a cam surface that engages the horizontal portion of the respective retaining prongs 90 (see FIG. 6). In this position, the seal arm locking member 68 is secured to the lid housing 40 through the retaining prongs 90, and the drink seals 72 of the seal assembly 16 are forced against the drink openings via the drink spring 70 to close the drink openings.

When the user desires to drink from the container 10, the user depresses the trigger member 42. In one embodiment, the trigger 42 is operated by pushing the trigger 42 in a direction substantially parallel to a longitudinal axis of the drinking container. If sufficient force is provided, the trigger member 42 initially depresses the vent pin 60 and vent seal 64 downwardly, compressing the vent spring 62 to initially open the vent aperture 20 during this first portion of the operation of the trigger mechanism. The vent pin 60 will ultimately bottom out in the vent pin receiver 110 of the seal arm 66. Again, if sufficient force is provided through the trigger member 42, during a second portion of the operation stroke of the trigger mechanism, when the vent pin 60 bottoms out in the vent pin receiver 110 of the seal arm 66, the force of the vent pin 60 moving downward will operate to push the seal arm 66 and compress the drink spring 70 to rotate the seal arm 66 about the extensions 86 within the receivers 84 of the lid housing arms 80. Since the seal arm locking member 68 is fixed in the locked position to the retaining prongs 90, the force exerted on the trigger member 42 must also be sufficient to overcome the force of the drink spring 70, thus allowing the seal arm 66 to compress the drink spring 70 and have the drink seals 72 moved away from the drink apertures to allow liquid to escape out of the drink apertures for drinking. Accordingly, the trigger mechanism is mechanically connected to the seal assembly, including the vent seal and the drink seals, during operation of the trigger mechanism to move the first and second drink seals and the vent seal from the closed position to the open position.

When the user removes force from the drink trigger 42 (i.e., generally by removing their thumb from the trigger 42), the force of the drink spring 70 will force the seal arm 66 to rotate toward the lid housing 40 and thereby have the drink seals 72 forced against the drink openings to close the drink openings. Further, the force of the vent spring 62 will force the vent pin 60 and vent seal 64 upwardly toward the lid housing 40 to close the vent opening 20. Accordingly, the trigger mechanism has three positions, a first position, a second position and a third position. The vent aperture is opened and the first and second drink apertures remain closed when the trigger mechanism reaches the first position. The first and second drink apertures are opened after the vent aperture when the trigger mechanism reaches the second position. Finally, the vent opening is subsequently closed but the first and second drink apertures remain open when the trigger mechanism is in the third position.

If the user desires to clean the lid assembly 14, the user can rotate the seal assembly 16 away from the drink surface of the lid housing 40 to provide access to the area between the drink openings 18*a*, 18*b* and the drink seals 72, and access to the area between the vent seal 64 and the vent opening 20. To do such, in one embodiment the user rotates the locking member 96 of the seal arm locking member 68 approximately 50°. By rotating the locking member 96, the arm lock 98 is also rotated and the wing arms will be disengaged from the retaining prongs 90 extending from the lid housing 40. When the wing arms of the arm locks 98 are disengaged from the retaining prongs 90 the entire trigger assembly 16 can be rotated away from the lid housing 40 about the extensions 86 of the seal arm 66 for cleaning. An additional feature of this embodiment is that the arms 80 interact with ribs on the seal arm 66 in a detent position to maintain the seal assembly 16 in the fully open position until forced back by the user. In this manner the seal assembly 16 will stay in the open position for cleaning, but can then be returned to its operating position by overcoming the detent resistance force. Accordingly, it is seen that the trigger member 42 is capable of engaging the seal assembly 16 when the seal assembly 16 is in the operable position, but the seal assembly 16, by nature of its physical location, cannot be engaged by the trigger member 42 when the seal assembly 16 is in the cleaning position.

As shown in FIG. 8, the surface of the seal arm 66 adjacent the arm lock 98 of the seal arm locking member 68 has a protrusion 120 and a stop 122 that operate as cams against the wing arms 104*a*, 104*b* of the arm lock 98. Specifically, in one embodiment the two wing arms 104*a*, 104*b* engage the protrusion 120 when rotating the seal arm locking member from the unlocked to the locked position, and depressions at the end of the protrusion 120 provide a tactile sensation to the user that the proper rotation stroke has been reached when unlocking the seal arm locking member 68.

To lock the seal arm locking member 68, and thus the seal assembly 16, the user pushes the seal assembly 16 toward the lid housing 40 and performs a reverse rotation of the locking member 68. When this reverse rotation of the seal arm locking member 68 is performed and completed, the stop 122 of the seal arm 66 will operate to block further movement of the seal arm locking member 68 and the wing arms 104*a*, 104*b* of the arm lock 98 will be properly seated on the retaining prongs 90.

Figure 5:
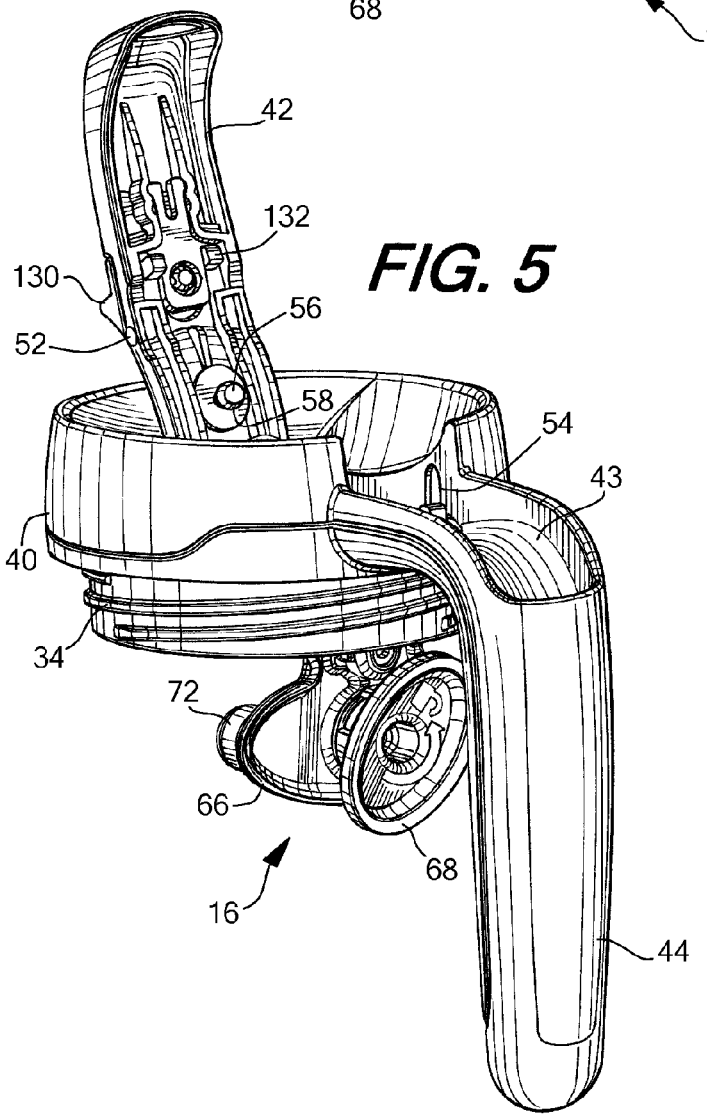
FIG. 5 is a perspective view of the lid with the trigger button and trigger assembly in the open positions.

The lid assembly 14 also has a trigger locking mechanism to prevent the trigger member 42 from being actuated when the seal assembly 16 is in the locked position. Specifically, a locking member 130 portion of the trigger member 42 can be transitioned from the unlocked position, where the trigger member 42 can be rotated to actuate the seal assembly 16, to a locked position, where the trigger member 42 cannot be rotated to actuate the seal assembly 16. The locking member portion 130 of the trigger member 42 is shown in FIGS. 5-7. The locking member portion 130 of the trigger member 42 is moveable radially inwardly and outwardly on the trigger member 42 when the trigger member 42 is connected to the lid housing 14. The locking member portion 130 also has protrusions 132 that extend into the cavity 43 of the handle 44. In the unlocked position the protrusions 132 do not contact anything and thus the trigger member 42 can be freely depressed. When the locking member portion 130 is slid radially inward (i.e., toward a center of the lid 40) to the "Locked Position," the protrusions 132 on the locking member portion 130 line up with a raised cam surface 134 (see FIG. 12) extending from the lid housing 40 in the cavity 43. Thus, in this Locked Position the raised cam surface 134 engages the protrusions 132 and prevents the trigger member 42 from being depressed. When the locking member portion 130 of the trigger member 42 is slid back to the unlocked position, the protrusions 132 do not line up with the raised cam surfaces 134 and the trigger 42 can be freely depressed to actuate the seal assembly 16. Additionally, as seen in FIG. 1, the locking member portion 130 of the trigger member 42 forms a continuous circular ring portion of the lid housing 40 at the upper outer surface of the lid housing 40 when the locking member 130 is in the unlocked state. However, when the locking member 130 is transitioned to the locked state, the continuous circular ring portion of the upper outer surface of the lid housing 40 is broken (i.e., the locking member 130 is moved radially inward), providing a visual indication to the user that the trigger member 42 is locked and the seals cannot be operated.

Several alternative examples have been described and illustrated herein. A person of ordinary skill in the art would appreciate the features of the individual embodiments, and the possible combinations and variations of the components. A person of ordinary skill in the art would further appreciate that any of the examples could be provided in any combination with the other examples disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A lid assembly for a beverage container, comprising:

a lid housing having a drink aperture;

a seal arm connected to the lid housing and movable between a first position, wherein the seal arm is adjacent the drink aperture, and a second position, wherein the seal arm is distal the drink aperture, the seal arm being connected to the lid housing in the first position and the second position, the first position being an operable position for assisting in opening and closing the drink aperture, and the second position being a cleaning position wherein the drink aperture is open for cleaning the lid assembly and wherein the seal arm is not capable of assisting in closing the drink aperture in the second position;

a drink seal connected to one of the drink aperture and the seal arm to assist in sealing the drink aperture; and, a trigger member connected to the lid housing, wherein the trigger member is capable of operating the seal arm in the first position, and wherein the seal arm cannot be operated by the trigger member in the second position.

2. The lid assembly of claim 1, wherein the trigger member is operated by pushing a trigger mechanism in a direction substantially parallel to a longitudinal axis of the beverage container.

3. The lid assembly of claim 1, wherein the seal arm pivots away from a drink surface of the lid housing when it moves to the second position.

4. The lid assembly of claim 1, wherein the lid housing has a second drink aperture, and further comprising a second seal arm connected to the lid housing and movable between a first position, wherein the second seal arm is adjacent the second drink aperture, and a second position, wherein the second seal arm is distal the second drink aperture, the second seal arm being connected to the lid housing in the first position and the second position, the first position being an operable position for assisting in opening and closing the second drink aperture, and the second position being a cleaning position wherein the second drink aperture is open for cleaning the lid assembly and wherein the seal assembly is not capable of assisting in closing the second drink aperture in the second position, and wherein the trigger member is capable of operating the first seal arm and the second seal arm in the first position, and wherein the trigger member cannot operate the first seal arm and the second seal arm in the second position.

5. The lid assembly of claim 4, further comprising a second drink seal connected to one of a second drink opening and the second seal arm to assist in sealing the second drink aperture.

6. The lid assembly of claim 1, wherein the trigger member is pivotally connected to the lid housing, and wherein the trigger member can be pivoted from a normal or use position to an open position for cleaning purposes.

7. The lid assembly of claim 1, wherein the seal arm can pivot approximately 90° to transition from the first or operable position to the second or cleaning position.

8. The lid assembly of claim 1, further comprising a locking member to lock the seal arm in the operable position when the locking member is in a locked state, the locking member transitionable to an unlocked state to allow the seal assembly to be moved to the cleaning position.

9. The lid assembly of claim 1, further comprising a trigger lock connected to the trigger member, the trigger lock preventing engagement of the seal arm by the trigger member when the seal arm is in the operable position.

10. A lid assembly for a beverage container, comprising:

a lid housing having a drink aperture and a seal arm, the seal arm being connected to the lid housing and movable between a first position wherein the seal arm is adjacent the drink aperture and wherein the seal arm can assist in closing and opening the drink aperture, and a second position wherein the seal arm is distal the drink aperture, the seal arm being connected to the lid housing in the first position and the second position, the first position being an operable position for opening the drink aperture when the seal arm is in an open position and closing the drink aperture when the seal arm is in the closed position, and the second position being a cleaning position wherein the drink aperture is open for cleaning the lid assembly, the cleaning position of the seal arm being different from the open position and the closed position of the seal arm.

11. The lid assembly of claim 10, further comprising a drink seal connected to one of the drink aperture and the seal arm to assist in sealing the drink aperture.

12. The lid assembly of claim 10, further comprising a trigger member connected to the lid housing, wherein the trigger member is capable of operating the seal arm in the first position, and wherein the seal arm cannot be operated by the trigger member in the second position.

13. A lid assembly for a beverage container, comprising:

a lid housing having a drink aperture;

an actuated seal arm connected to the lid housing and movable between a first position wherein the seal arm is adjacent the drink aperture and wherein the seal arm can assist in closing and opening the drink aperture, and a second position wherein the seal arm is distal the drink aperture, the seal arm being connected to the lid housing in the first position and the second position, the first position being an operable position for opening the drink aperture when the seal arm is in an open position and closing the drink aperture when the seal arm is in the closed position, and the second position being a cleaning position wherein the drink aperture is open for cleaning the lid assembly, the cleaning position of the seal arm being different from the open position and the closed position of the seal arm; and, a drink seal connected to one of the drink aperture and the seal arm to assist in sealing the drink aperture.

14. The lid assembly of claim 13, further comprising an actuator operably connected to the lid housing to actuate the seal arm when the seal arm is in the first position.

15. The lid housing of claim 14, wherein the actuator cannot actuate the seal arm when the seal arm is in the second position.

* * * * *